US010413099B2

(12) United States Patent
Stewart

(10) Patent No.: US 10,413,099 B2
(45) Date of Patent: Sep. 17, 2019

(54) SIMULATED DUVET COVER SYSTEM

(71) Applicant: Standard Textile Co., Inc., Cincinnati, OH (US)

(72) Inventor: Richard Stewart, Mason, OH (US)

(73) Assignee: Standard Textile Co., Inc., Cincinnati, OH (US)

( * ) Notice: Subject to any disclaimer, the term of this patent is extended or adjusted under 35 U.S.C. 154(b) by 396 days.

(21) Appl. No.: 15/281,826

(22) Filed: Sep. 30, 2016

(65) Prior Publication Data

US 2018/0092473 A1 Apr. 5, 2018

(51) Int. Cl.
*A47G 9/02* (2006.01)

(52) U.S. Cl.
CPC ..... *A47G 9/0261* (2013.01); *A47G 9/02* (2013.01); *A47G 9/0207* (2013.01); *A47G 9/0223* (2013.01)

(58) Field of Classification Search
CPC ..... A47G 9/02; A47G 9/0207; A47G 9/0223; A47G 9/0261
See application file for complete search history.

(56) References Cited

U.S. PATENT DOCUMENTS 2,821,723 A * 2/1958 Gluck ..... A47G 9/0238 5/501
3,754,692 A 8/1973 Sanders
4,903,361 A * 2/1990 Tang ..... A47G 9/02 5/500
5,199,121 A * 4/1993 Payne ..... A47G 9/0207 5/413 R (Continued)

FOREIGN PATENT DOCUMENTS

DE 3738397 A1 7/1988
DE 202005002388 U1 7/2005

(Continued)

OTHER PUBLICATIONS

International Searching Authority, Search Report and Written Opinion issued in International Applicaiton No. PCT/US2017/044647 dated Nov. 2, 2017 (16 pages).

(Continued)

*Primary Examiner* — Robert G Santos
*Assistant Examiner* — Rahib T Zaman
(74) *Attorney, Agent, or Firm* — Wood Herron & Evans LLP

(57) ABSTRACT

A simulated duvet cover system provides an easily-manufactured and assembled construction in which a cover layer, defined by top and bottom fabric sheets with pockets defined therebetween, is configured to be removably coupled to a separate fill layer, defined by a blanket or comforter. The bottom fabric sheet extends inwardly from the periphery of the top fabric sheet to surround a central opening, which the fill layer can be inserted through and then tucked into the pockets. A further backing layer may be connected to the cover layer with non-metallic and non-rigid fasteners such as fabric knot buttons, to cover the central opening. The system hides the appearance of the fill layer when in use, thereby providing a similar appearance to a conventional duvet cover, while still allowing for easy removal and cleaning of the system with industrial laundering equipment or the like.

13 Claims, 11 Drawing Sheets

(56) References Cited

U.S. PATENT DOCUMENTS

| | | | | |
|---|---|---|---|---|
| 5,299,333 | A * | 4/1994 | Pedersen | A47G 9/10 5/486 |
| 5,720,058 | A * | 2/1998 | Hollander | A47G 9/0207 5/486 |
| 6,032,308 | A * | 3/2000 | Chuang | A47G 9/0261 5/413 AM |
| 6,637,054 | B2 * | 10/2003 | Chuang | A47G 9/0261 5/482 |
| 7,013,509 | B2 * | 3/2006 | Hickman | A47G 9/0253 5/485 |
| 8,011,038 | B2 * | 9/2011 | Balasundharam | A47G 9/0238 5/482 |
| 8,458,832 | B1 | 6/2013 | Krishna | |
| 8,549,682 | B2 * | 10/2013 | Low | A47G 9/0261 5/501 |
| 8,689,375 | B2 * | 4/2014 | Stinchcomb | A47G 9/02 5/502 |
| 9,089,228 | B2 * | 7/2015 | Shattuck | A47G 9/0223 |
| 9,095,230 | B2 * | 8/2015 | Shattuck | A47G 9/0223 |
| 2004/0068795 | A1 * | 4/2004 | Hollander | A47G 9/0207 5/502 |
| 2005/0144721 | A1 * | 7/2005 | Linnane | A47G 9/0261 5/501 |
| 2008/0189857 | A1 * | 8/2008 | Delfs | A47G 9/0207 5/502 |
| 2011/0023234 | A1 | 2/2011 | Bolish et al. | |
| 2011/0035881 | A1 | 2/2011 | Cohen | |
| 2012/0297541 | A1 * | 11/2012 | Brown | A47G 9/02 5/490 |
| 2014/0157575 | A1 | 6/2014 | Stinchcomb | |
| 2015/0082540 | A1 | 3/2015 | Sirok et al. | |
| 2015/0157147 | A1 * | 6/2015 | Haraszta | A47G 9/0261 5/501 |
| 2016/0338513 | A1 * | 11/2016 | Mittal | A47G 9/0207 |
| 2017/0071368 | A1 | 3/2017 | Pelaez | |
| 2017/0127855 | A1 | 5/2017 | Wootten, Jr. | |
| 2018/0255946 | A1 | 9/2018 | Stewart et al. | |

FOREIGN PATENT DOCUMENTS

| | | | |
|---|---|---|---|
| FR | 2868274 | A1 | 10/2005 |
| GB | 2272639 | A | 5/1994 |
| GB | 2389523 | A | 12/2003 |
| GB | 2415371 | A | 12/2005 |
| JP | 2002325668 | A | 11/2002 |
| JP | 2003116693 | A | 4/2003 |
| WO | 2010022446 | A1 | 3/2010 |

OTHER PUBLICATIONS

International Searching Authority, Notification of Transmittal of the International Preliminary Reporty on Patentability issued in International Applicaiton No. PCT/US2017/044647 dated Nov. 7, 2018 (15 pages).

International Searching Authority, Search Report and Written Opinion issued in International Applicaiton No. PCT/US2017/044673 dated Nov. 24, 2017 (14 pages).

International Searching Authority, Written Opinion issued in International Applicaiton No. PCT/US2017/044647 dated Aug. 21, 2018 (6 pages).

* cited by examiner

SIMULATED DUVET COVER SYSTEM

TECHNICAL FIELD

The present invention relates generally to linens used with bedding and, more specifically, to cover systems used with bedding in various contexts.

BACKGROUND

Blankets and comforters, such as down comforters, provide an extra layer of comfort and warmth to those who choose to use them while sleeping. For example, a down comforter provides more warmth and comfort as compared to sleeping under only a top sheet of a sheet set applied to a bed. However, because of the bulk/size of comforters and blankets, they can be very difficult to properly clean. In order to diminish the need for direct cleaning and extend the life thereof, these blankets and comforters are often covered with (and/or inserted within) what is known as a duvet cover. The duvet cover protects the blanket or comforter while, at the same time, contributes an aesthetically appealing element to the bed when positioned atop the bed. When used in place of a top sheet, as many persons choose to do, the duvet cover is in regular contact with the human body and therefore should be cleaned on a regular basis. This cleaning necessitates removal of the duvet cover from the blanket or comforter.

One conventional version of a duvet cover 500 is shown in FIG. 10. The duvet cover 500 is defined by a top panel 502 of fabric material and a bottom panel 504 of fabric material, which are generally permanently coupled together, such as by stitching, along a first portion 506 of the periphery thereof, and which define an opening 508 along a second portion 510 of the periphery thereof. This opening 508 may be permanently open, or in some embodiments, the opening 508 may be selectively closed by a connection mechanism such as the zipper 512 shown in FIG. 10. The blanket or comforter 514, or some other similar type of filler, is pushed through the opening 508 to be sandwiched between the top and bottom panels 502, 504, in a similar fashion as inserting a pillow into a pillowcase. However, unlike a pillow, the blanket or comforter 514 is substantially large in size and capable of bunching up or folding over itself when being inserted into the duvet cover 500 through the opening 508. This can cause significant difficulties and delays when an operator tries to properly position the blanket or comforter 514 within the duvet cover 500. Likewise, removing the large blanket or comforter 514 from within the duvet cover 500 can also be difficult and time-consuming. Even when connection mechanisms such as the zipper 512 are provided to widen the opening 508, these difficulties still exist, and moreover, the zipper 512 is prone to defective operations as well. These deficiencies are exacerbated in commercial contexts such as hotels and hospitals, where bedding materials can require washing every day, in some circumstances.

Furthermore, in those commercial contexts, the washing and follow-up processing of bedding materials is often performed by large commercial or industrial washers, dryers, and folding/ironing equipment. Each of these systems can cost multiple thousands of dollars (or hundreds of thousands of dollars), so avoiding the inclusion of features on bedding materials which can potentially damage these commercial/industrial machines is important. For example, the commercial ironing and folding equipment can process fabric materials of many varieties, but any metallic or hard materials such as buttons or zippers tend to damage the equipment during operation (or become melted or damaged themselves, in the case of buttons and the like). As such, the conventional duvet cover 500 like the one shown in FIG. 10 cannot be used in commercial contexts where all linens get processed through these machines, which could be damaged by the zipper 512, for example. The alternative of hand processing all the duvet covers is typically not a viable option in most commercial contexts, at least as a result of the large number of linen/bedding sets that need to be cleaned every day, and the complexity and difficulty of assembling the duvet cover with the blanket or comforter after each cleaning.

Conventional duvet covers therefore do not find as significant of use as would be expected in places like hotels, as a result of complications resulting from the potential need to remove and replace a duvet cover on a plurality of beds every single day of operation, as well as the limiting factors of types of bedding materials that can be processed in commercial/industrial washing, drying, and ironing/folding machines. Additionally, the conventional designs for duvet covers are fairly labor-intensive to assemble and thus come with added manufacturing costs, which can further discourage commercial hotel and hospital operators from purchasing and using such products. Accordingly, bedding options and decorative options that can be offered to guests and patients are often reduced in these fields.

It would be desirable, therefore, to provide a new duvet cover or similar cover system that addresses these and other drawbacks of conventional designs of duvet covers, including covers like the one shown in FIG. 10.

SUMMARY

In one embodiment, a simulated duvet cover system is provided for encasing and retaining a fill layer defined by at least one of a comforter or a blanket, and thereafter to be used for covering a bed. The system includes a top fabric layer having a periphery with a plurality of side edges. The system also includes a bottom fabric layer connected to the top fabric layer and extending inwardly from the periphery at each of the side edges to form pockets extending along the periphery. The bottom fabric layer therefore is surrounding a central opening extending between the pockets. The top and bottom fabric layers collectively define a cover layer configured to receive the fill layer by insertion of the fill layer through the central opening and tucking the fill layer into the pockets to sandwich the fill layer between the top and bottom fabric layers. The pockets are sized to retain the fill layer in a fully assembled position. The cover layer is also configured to be removed for cleaning separate from the fill layer. Thus, the simulated duvet cover system provides easy assembly and disassembly for cleaning of the cover layer separate from the fill layer, while also simulating the appearance of a conventional duvet cover, as is typically desired.

In one aspect, which may be combined with any combination of the features described herein, the pockets and the central opening collectively define a picture frame-shaped receptacle for retaining the fill layer in position relative to the cover layer. Advantageously, the cover layer includes no metallic or substantially rigid elements (like snaps and the like) which could damage industrial laundering equipment such as flatwork ironing equipment during a cleaning and processing cycle. As a result, the simulated duvet cover system is readily configured for use in commercial settings such as hotels and hospitals, where such industrial cleaning equipment is used and where frequent changes and cleanings of linens are considered necessary.

In another aspect which may be combined with any of the features described herein, the cover system is spread over a top sheet of a sheet set placed on the bed. In such an arrangement, the cover layer is positioned to prevent any direct contact with the fill layer during use on the bed. Each of the pockets extends between about 12 inches and 24 inches from the corresponding side edge of the periphery. Furthermore, in some embodiments, each of the pockets defines a depth measured between the central opening and the corresponding side edge, with the depth of all the pockets being the same.

In a further aspect, which may be combined with any of the features described herein, each of the pockets defines a depth measured between the central opening and the corresponding side edge, with the depth of some of the pockets being different from others. This results in some of the pockets being differently sized than other pockets. In a further example, the periphery of the top fabric layer may specifically include a head end edge configured to extend along a head end of the bed, a foot end edge configured to extend along a foot end of the bed, and first and second side edges. The pocket extending inwardly from the head end edge may be sized larger in depth than at least one of the remaining pockets, which may assist with reliably retaining the fill layer in the fully assembled position (e.g., within the pockets). In such an embodiment, the pocket that extends inwardly from the head end edge may be defined by a generally rectangular piece of fabric connected to the remainder of the bottom fabric layer at an inner edge thereof (opposite the head end edge). This arrangement spaces apart any sew lines from the head end edge that would possibly become visible if the head end of the system is rolled back when in use on the bed.

The following additional features and aspects may also be included in combination with any of the features of the system described herein in further embodiments. The top fabric layer of the cover layer includes a decorative pattern for covering the bed. The bottom fabric layer may be formed from portions of the top fabric layer, which are folded over at the periphery and sewn together at junctions of the portions located in the bottom fabric layer. Alternatively, the bottom fabric layer may be formed from a different material than the top fabric layer, which would result in the bottom fabric layer being coupled to the top fabric layer along the periphery. The materials chosen for the fabric layers may be tailored to save costs and reliably retain the fill layer in position, while providing any desired aesthetic appearances and comfort/feel aspects that are required for the end user.

In another aspect, which may be combined with any of the features described herein, the system further includes a backing layer and a plurality of fastening elements. The backing layer is smaller in size than the cover layer so that it does not appear visible during normal use of the cover system on a bed (with the cover layer on top of the fill layer and the backing layer). The backing layer is configured to cover the central opening located at the bottom fabric layer of the cover layer. The fastening elements removably couple the backing layer to the bottom fabric layer at the pockets. The backing layer may be formed from a different material than the cover layer, or from the same material as the cover layer. Advantageously, the fastening elements are defined by materials that will not be damaged by, nor cause damage to, industrial laundering and ironing equipment during a cleaning and processing cycle. In one such example, the fastening elements are defined by fabric knot buttons and retainer apertures provided on the backing layer and on the bottom fabric layer of the cover layer. The fastening elements may also include at least two different types of fasteners, including but not limited to: the fabric knot buttons described above, hook and loop fastener panels, silicone buttons, and the like.

In another embodiment in accordance with the invention, which may be combined with any of the features of the system described above, a method is provided for covering a bed with a simulated duvet cover system. The method includes inserting a fill layer in the form of a blanket or comforter through a central opening defined in a cover layer having a top fabric layer and a bottom fabric layer. The top fabric layer has a periphery with a plurality of side edges, and the bottom fabric layer extends inwardly from the periphery at each of the side edges to form pockets that surround the central opening. The method also includes tucking the fill layer into the pockets so as to retain the fill layer between the top and bottom fabric layers of the cover layer to define a fully assembled position of the system. The method then includes laying the simulated duvet cover system in the fully assembled position onto the bed with the top fabric layer facing upwardly, which causes the fill layer to remain hidden from view as a result of being tucked into the pockets with the central opening facing towards the bed. The cover layer is configured to be removed for cleaning separate from the fill layer. In some further embodiments of the method, further steps include laying a backing layer that is smaller in size than the cover layer over the central opening provided in the bottom fabric layer, specifically after inserting the fill layer through the central opening. A plurality of fastening elements can then be used to couple the backing layer to the bottom fabric layer to cover the central opening and thereby further retain the fill layer in position between the top and bottom fabric layers.

BRIEF DESCRIPTION OF THE DRAWINGS

The accompanying drawings, which are incorporated in and constitute a part of this specification, illustrate embodiments of the invention and, with a detailed description of the embodiments given below, serve to explain the principles of the invention.

DETAILED DESCRIPTION

Figure 10:
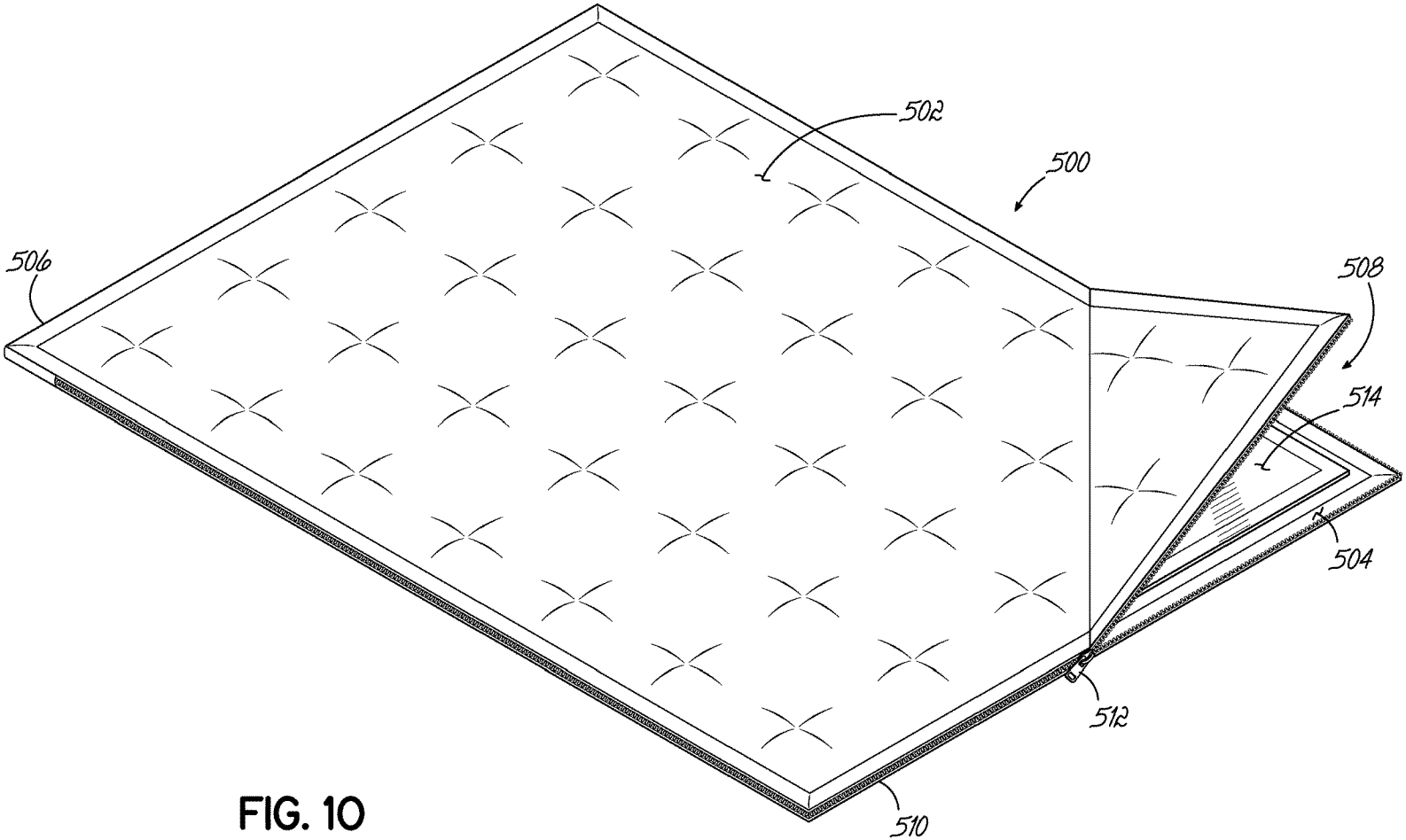
FIG. 10 PRIOR ART
FIG. 10 is a top perspective view of a conventional duvet cover having a closure zipper and a fill layer in the form of a blanket or comforter within the conventional duvet cover.

FIGS. 1 through 5B show a simulated duvet cover system 10 in accordance with one embodiment of the invention. As revealed most clearly in FIGS. 2 and 4, the system 10 of this embodiment includes two separate pieces in the form of a cover layer 12 and a backing layer 14, which are assembled together to retain a fill layer 16 (defined by a blanket or comforter) and thereby simulate the performance, functionality, and general external appearance of a conventional duvet cover (such as the duvet cover 500 described above and shown in FIG. 10). Advantageously, these layers 12, 14 are configured for quick and easy assembly together with the fill layer 16 as a result of a plurality of pockets 18 located along one side of the cover layer 12 as well as a plurality of fastening elements 20, which connect the cover layer 12 to the backing layer 14 along the same side as the plurality of pockets 18. To this end, assembly of the system 10 with the fill layer 16 requires only the following: inserting the fill layer 16 through a central opening 22 in the cover layer 12, tucking the fill layer 16 into the pockets 18 to retain the cover layer 12 in position around the fill layer 16, and fastening the backing layer 14 to the cover layer 12 using the fastening elements 20 to effectively close the central opening 22. Thus, unlike the conventional duvet cover, the system 10 is readily removable and replaceable when cleaning is needed. Moreover, the system 10 is designed to hide the appearance of the fastening elements 20 when the system 10 is fully assembled and spread out on a bed 24, to thereby simulate the desirable appearance of a conventional duvet cover, and the fastening elements 20 are advantageously designed to be capable of going through industrial laundering and ironing equipment without being damaged or causing damage to that expensive and complex equipment. As such, the system 10 allows for the appearance and functionality of a blanket/comforter and duvet cover to be used in contexts where frequent cleaning and washing is required, including but not limited to hotels and hospitals. These and other beneficial features and functionality of the system 10 are described in detail below.

Use of several descriptive terms, such as top, bottom, head, foot, side, horizontal, and/or vertical, for example, as it pertains to/describes the simulated duvet cover system 10 and its components, is from the viewpoint of when the system 10 is laid out on the bed 24, unless otherwise noted. Furthermore, it will be understood that while the fill layer 16 is generally not described herein to be a part of the simulated duvet cover system 10, these elements can be provided together as an all-inclusive bedding or linen kit in some circumstances.

Figure 1:
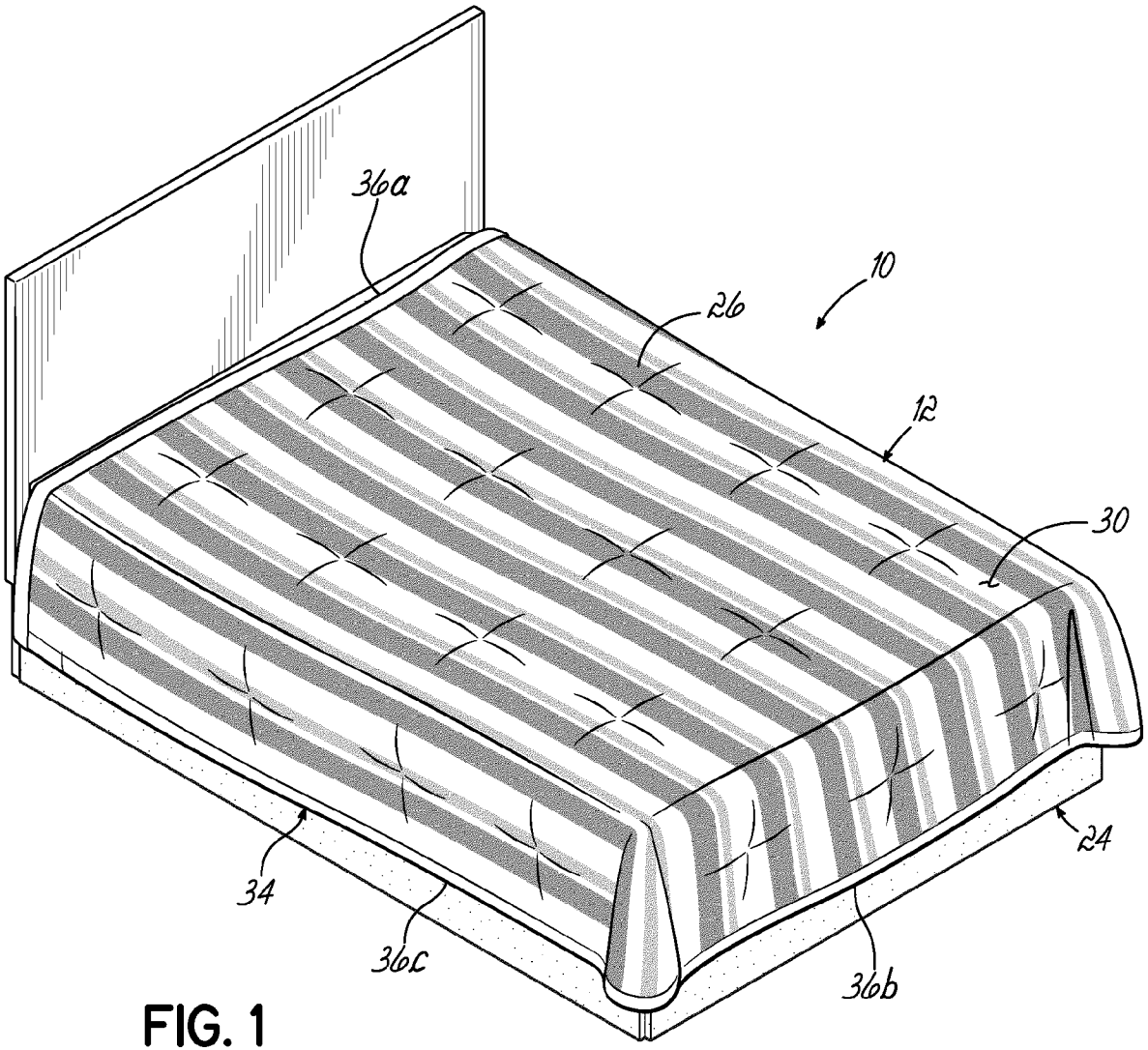
FIG. 1 is a top perspective view of a simulated duvet cover system, in accordance with one embodiment of the invention, and shown in the fully assembled state in combination with a fill layer while spread over a bed.
Figure 2:
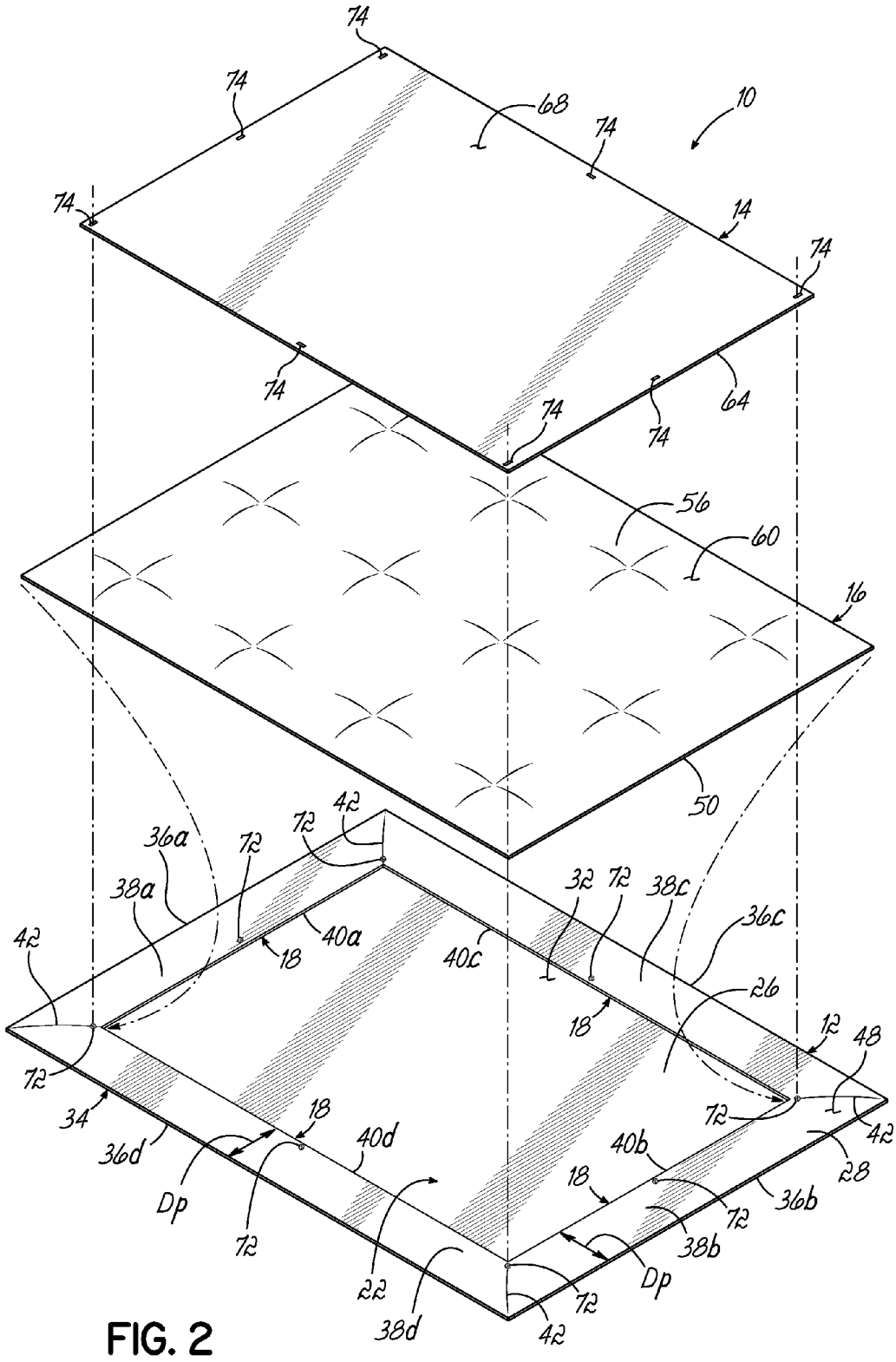
FIG. 2 is a bottom perspective view of the simulated duvet cover system of FIG. 1, with the plurality of layers defining the system partially exploded along with a fill layer inserted into the system, to reveal fastening elements used to secure these layers together when in the fully assembled state.
Figure 3:
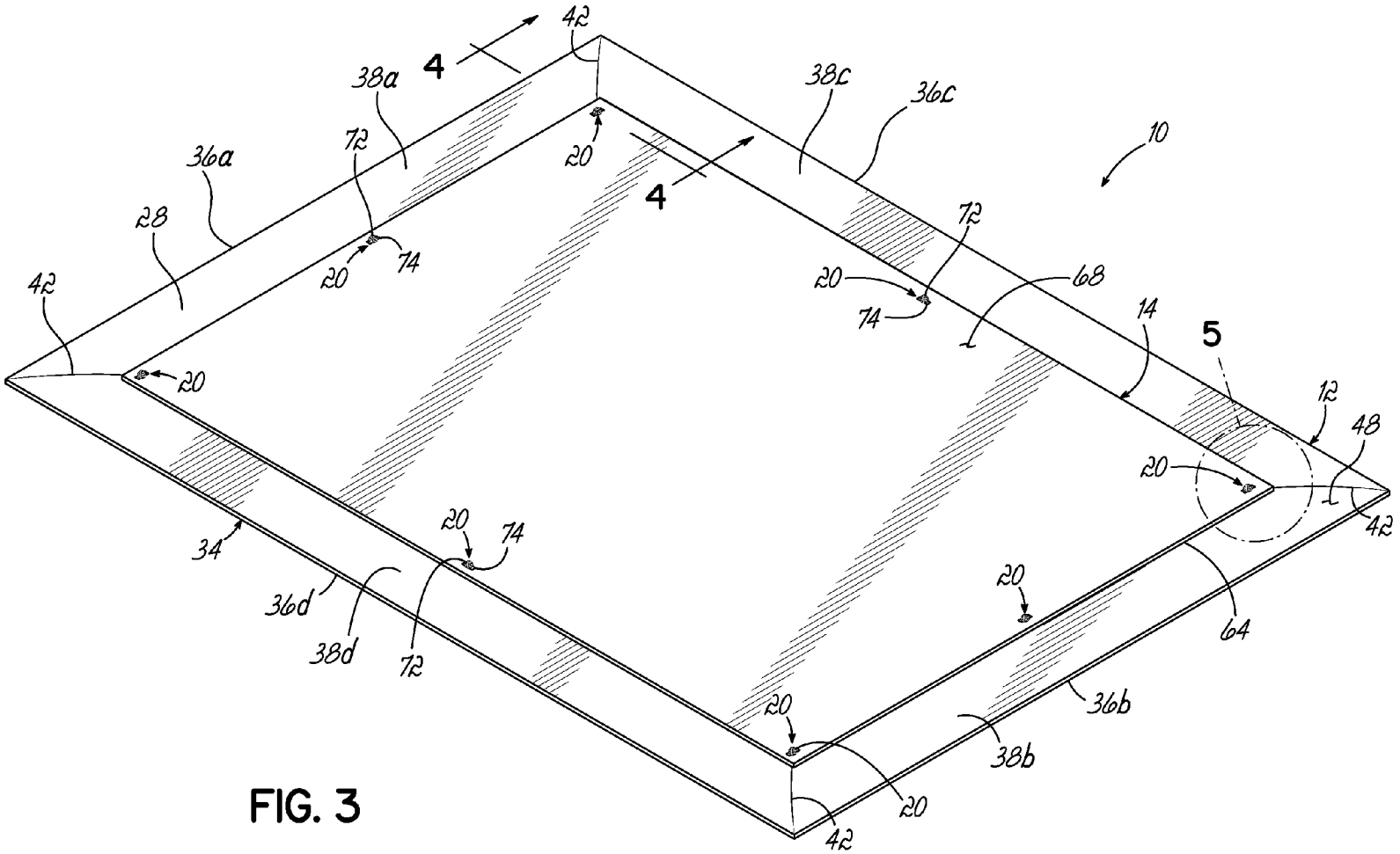
FIG. 3 is a bottom perspective view of the simulated duvet cover system of FIG. 1, with the system laid out in a completely horizontal orientation, and the system in the fully assembled state.

With specific reference to FIGS. 1 through 3, the system 10 is shown in further detail in accordance with the first embodiment disclosed herein. The cover layer 12, which is shown most clearly at FIGS. 1 and 2, includes a top fabric layer 26 and a bottom fabric layer 28 which is located generally parallel to the top fabric layer 26. More specifically, the top fabric layer 26 is a generally rectangular sheet of fabric having a top side 30 configured to face away from the bed 24 when the system 10 is in use, a bottom side 32 opposite the top side 30, and a periphery 34. As shown in this embodiment and most clearly at FIG. 1, the top side 30 of the top fabric layer 26 may include a decorative pattern that adds a desirable or specific aesthetic look when covering the bed 24. The decorative pattern may be applied to the top fabric layer 26 by any known method, including dyeing, printing, and the like. Furthermore, the decorative pattern may define any color and sequence as desired by the end user of the simulated duvet cover system 10. The bottom fabric layer 28 extends inwardly from the periphery 34 to define, at least in part, the pockets 18 and the central opening 22 as set forth in further detail below. The periphery 34 includes a plurality of side edges, such as a head end edge 36*a*, a foot end edge 36*b*, and first and second side edges 36*c*, 36*d* extending between the head and foot end edges 36*a*, 36*b*. As will be readily understood from FIG. 1, the head end edge 36*a* is configured to extend along a head end of bed 24 when the system 10 is placed on the bed 24, while the foot end edge 36*b* is configured to extend along a foot end of the bed 24 in the same circumstance.

Now with reference to FIGS. 2 and 3, the bottom fabric layer 28 is shown in further detail. The bottom fabric layer 28 of the embodiment shown in these Figures includes a plurality of separate portions which extend inwardly from each of the various edges 36*a*-36*d* defined by the periphery 34, to thereby collectively form a picture frame shaped receptacle when combined with the top fabric layer 26. For example, one fabric portion 38*a* extends from the head end edge 36*a* at the periphery 34 to a corresponding inner edge 40*a* defining one side of the central opening 22. The inner edge 40*a* extends generally parallel to the head end edge 36*a*. Likewise, another fabric portion 38*b* extends from the foot end edge 36*b* at the periphery 34 to a corresponding inner edge 40*b* at the central opening 22, and so on for the remaining fabric portions 38*c*, 38*d* located along the first and second side edges 36*c*, 36*d* and having inner edges 40*c*, 40*d*.

Each of the fabric portions 38*a*-38*d* is coupled to adjacent portions along intersections or junctions thereof, shown as diagonal sew lines 42 extending between the corners of the central opening 22 and the corners of the periphery 34 in this embodiment. It will be appreciated that the fabric portions 38*a*-38*d* of the bottom fabric layer 28 may be otherwise connected together and in different locations than the layout shown in FIGS. 2 and 3, and these fabric portions 38*a*-38*d* may also be omitted in some other embodiments in favor of a unitary frame-shaped piece of fabric. Regardless of the particular construction and arrangement of the bottom fabric layer 28, the pockets 18 formed by the top and bottom fabric layers 26, 28 along each side of the periphery 34 collectively surround the central opening 22, which facilitates easy insertion or removal of the fill layer 16 to and from the pockets 18 during the assembly and disassembly procedures for the system 10 described in this application.

Each of the pockets 18 (or alternatively, each of the fabric portions 38*a*-38*d*) defines a depth $D_p$ measured between the periphery 34 and the corresponding inner edges 40*a*-40*d* at the central opening 22. This depth $D_p$ is the same for all of the pockets 18 in this embodiment, which means that all of the pockets 18 are the same size. For the sake of clarity, the "size" of the pockets 18 in this and other embodiments primarily refers to their depth, as the side edge lengths around the periphery 34 may vary in different embodiments of the system 10, and as such, the longitudinal lengths of the pockets 18 will always vary in accordance with the side edges of the periphery 34. However, the depth or size of the pockets 18 defines what portion of the fill layer 16 is tucked inside the pockets 18 and underneath the bottom fabric layer 28 when the fill layer 16 is inserted into the cover layer 12. This portion of the fill layer 16 and the corresponding depth of the pockets 18 is designed to be sufficient to reliably hold the fill layer 16 against unintentional falling out through the central opening 22. In one example, a depth $D_p$ of about 12 to 24 inches for each of the pockets 18 has been found in some embodiments to be sufficient to reliably retain the fill layer 16 in the fully assembled position. However, it will be understood that in other embodiments of the system 10 (some of which are shown and described below), the depth and size of the pockets 18 may be varied without departing from the scope of this disclosure, so long as the new depth or size remains sufficient to reliably retain the fill layer 16.

Likewise, the particular materials used for the bottom fabric layer 28 may also vary depending on the embodiment. In some embodiments, the bottom fabric layer 28 is formed from the same material as the top fabric layer 26. For example, the fabric portions 38*a*-38*d* described above may be defined by flap-like portions of the sheet defining the top fabric layer 26, which are then folded over at the side edges of the periphery 34 and coupled together, such as shown by the sew lines 42. Although the junctions and sew lines 42 are shown at approximate 45 degree angles in the illustrated embodiment, it will be appreciated that the specific junctions and couplings may be varied in position in other embodiments, at least one of which is described in detail below.

Alternatively, the bottom fabric layer 28 in other embodiments is formed from a different fabric material than the material of the top fabric layer 26. In such embodiments, the top and bottom fabric layers 26, 28 would be secured together such as by sewing along the periphery 34. The bottom fabric layer 28 could be provided using less expensive fabrics, or fabrics with a different aesthetic quality, than the top fabric layer 26 in one example, as the top fabric layer 26 is what carries the decorative feature and is most often visible when the system 10 is spread out onto the bed 24. In such embodiments where a different material is used for the bottom fabric layer 28, the material must still define sufficient rigidity or stiffness to hold the fill layer 16 in position when the system 10 is fully assembled. In this regard, any material may be used for the bottom fabric layer 28 (and also the top fabric layer 26), so long as the depth of the pockets 18 and the materials chosen result in reliable retention of the fill layer 16 to achieve the primary functionalities of the system 10, including providing the appearance and operation of a conventional duvet cover while also being easy to remove from the fill layer 16 for cleaning cycles.

The top and bottom fabric layers 26, 28 defining the cover layer 12 can be constructed of various fabrics such as conventional materials that are typically used in the construction of sheets and similar bedding materials. Fabric construction can be woven, non-woven, or knitted. In one example, the fabric construction is a woven plain weave. The fabric can include natural and/or synthetic fibers and may be lint free, as desired. In one example, the fabric includes polyester, polypropylene, and/or cotton. In another example, the fabric is substantially polyester, substantially cotton, or a polyester/cotton blend (e.g., a 50/50 or other specialized mixtures or weaves as commercially available from Standard Textile Co., Inc., the assignee of this application). The fabric also may incorporate additional elements such as, but not limited to: ESD (electrostatic dissipative)/anti-static yarns, including nylon or carbon fibers, and the like; liquid resistant material, such as polyester or polypropylene; liquid resistant coatings or finishes that conform to at least minimum standards established for Level 1 classification by AAMI PB70 Standard, such as a fluorocarbon based finish; and/or an antimicrobial finish. These additional elements can comprise about 1% of the total material of the system 10, but may be provided in a greater or lesser amount as desired. These are but some examples of the materials that can be used to form the cover layer 12.

Figure 4:
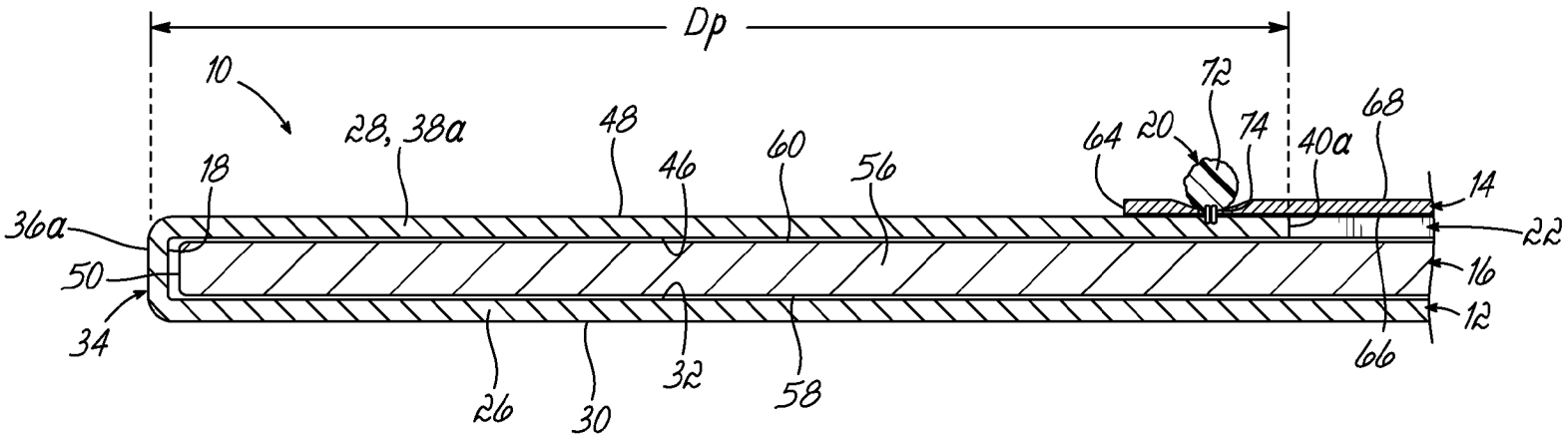
FIG. 4 is a side elevation cross-sectional view through one of the corner portions of the simulated duvet cover system and the fill layer of FIG. 3, taken along line 4-4 in FIG. 3, to reveal the plurality of layers and the details of one of the fastening elements when the system is in the fully assembled state.

As a result of the construction using fabric sheets or layers, the cover layer 12 defines a small thickness relative to the lateral dimensions of width and length, which are visible when viewing the cover layer 12 from the bottom as in FIG. 2, and also in partial cross-section in FIG. 4. The small thickness helps make the cover layer 12 easy to handle, manipulate, and clean, while also not adding too much bulk to the existing blanket or comforter defining the fill layer 16, which is often a thick, insulated layer of material by itself. Although the embodiments shown in the drawings of this application have the top fabric layer 26 and the bottom fabric layer 28 defined by a single layer of fabric across the majority of the surface area covered, multi-layer fabrics and construction are also possible in other embodiments. To this end, the materials chosen for the cover layer 12 and its construction can be tailored to meet the needs of various end users in various commercial or technical settings.

The bottom fabric layer 28 of the cover layer 12 includes a top surface 46 (visible in FIG. 4), which faces towards the bottom side 32 of the top fabric layer 26, and a bottom surface 48 configured to face towards the bed 24 when the system 10 is spread out in use as shown in FIG. 1. Each of the pockets 18 is specifically defined by the space between the top surface 46 of the bottom fabric layer 28 and the bottom side 32 of the top fabric layer 26. Therefore, when the fill layer 16 is "tucked" into the pockets 18, a peripheral edge 50 of the fill layer 16 is retained between the top surface 46 of the bottom fabric layer 28 and the bottom side 32 of the top fabric layer 26. To this end, the cover layer 12 is installed on the fill layer 16 in somewhat of a similar fashion as a fitted sheet would be on a mattress. Indeed, the fabric material defining the top and bottom fabric layers 26, 28 of some embodiments may have some resiliency in order to function to retain the fill layer 16 in position in the pockets 18 without inadvertently falling out through the central opening 22.

Figure 5A:
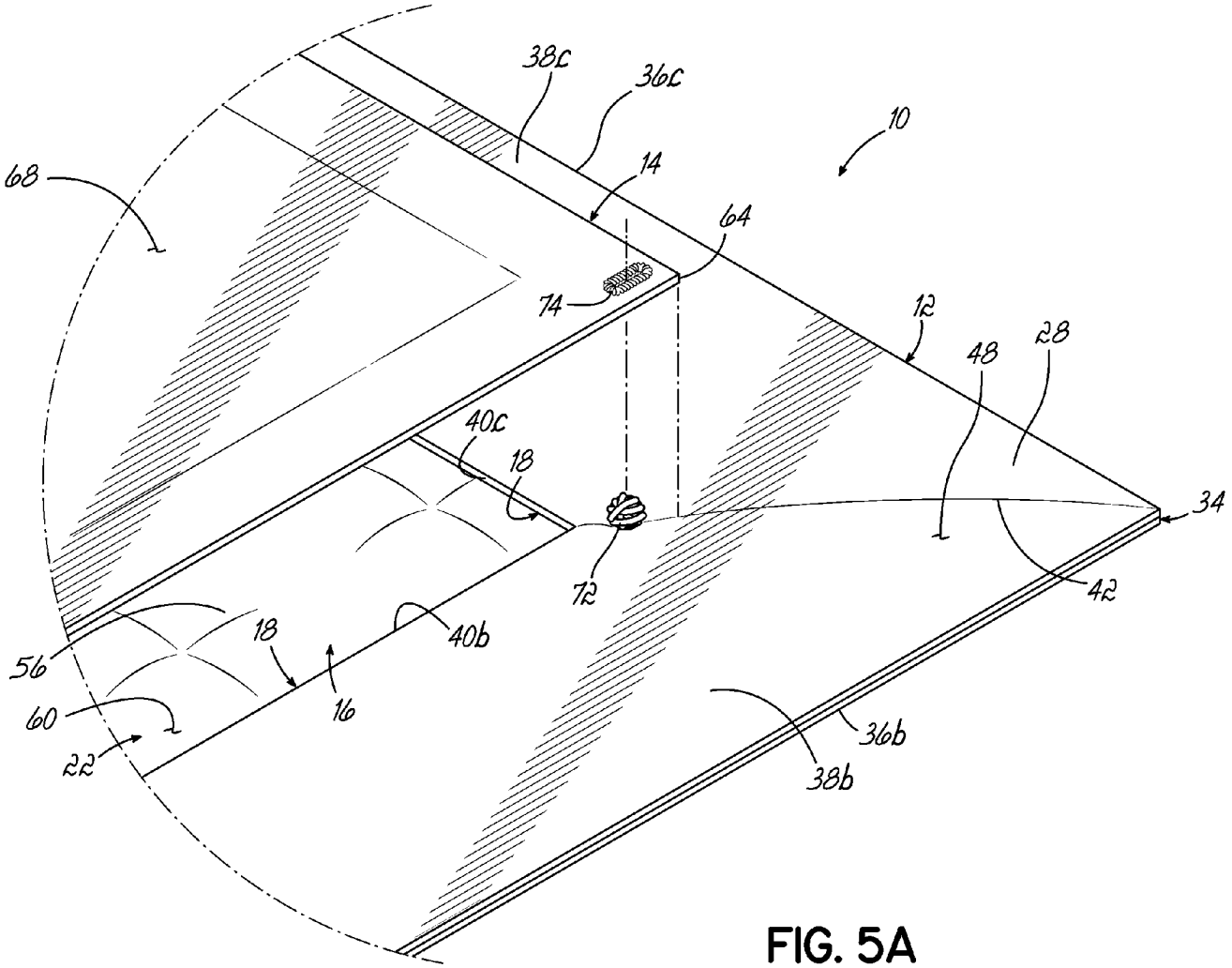
FIG. 5A is a detailed perspective view of one of the corner portions defined by the simulated duvet cover system as identified in detail 5 of FIG. 3, with the layers defining the simulated duvet cover system partially exploded to reveal portions of a fastening element used to couple these layers together when the fill layer is in position within the system.

Now turning to the fill layer 16, this element (that is configured to be retained by the simulated duvet cover system 10) is visible at FIG. 2 as well as in part at FIGS. 4 and 5A. The fill layer 16 is defined by a blanket or comforter 56, which is configured to provide a thickened layer of insulating filler which insulates the bed 24 and persons located under the system 10 from the external environment about the bed 24. In this regard, the fill layer 16 is sandwiched in this embodiment of the system 10 between the cover layer 12 and the backing layer 14, and also typically defines a larger thickness than either of these other layers. The aforementioned peripheral edge 50 of the fill layer 16 generally matches the shape and size of the periphery 34 defined by the cover layer 12, albeit typically with slightly smaller overall width and length dimensions such that the fill layer 16 can fit within the pockets 18 defined by the cover layer 12. To this end, the fill layer 16 has a generally rectangular shape and the peripheral edge 50 thereof includes various side edges similar to the head end edge 36*a*, the foot end edge 36*b*, and the first and second side edges 36*c* and 36*d* of the cover layer 12. Accordingly, the fill layer 16 when spread out has roughly the same size in plan view as the cover layer 12.

The blanket or comforter 56 further includes a top surface 58 and a bottom surface 60 each delimited by the peripheral edge 50. The top surface 58 of the blanket or comforter 56 faces towards the top fabric layer 26 of the cover layer 12 when the system 10 is fully assembled, while the bottom surface 60 of the blanket or comforter 56 faces towards the bottom fabric layer 28 and toward the backing layer 14 when fully assembled. Advantageously, the fill layer 16 is substantially enclosed around its peripheral edge 50 and effectively hidden from view when the simulated duvet cover system 10 is in normal use, as shown at FIG. 1 for example. The fill layer 16 also remains substantially enclosed and hidden at the bottom surface 60 thereof as a result of coverage provided by the bottom fabric layer 28 of the cover layer 12 as well as the backing layer 14, as shown most clearly in FIG. 3. In this regard, even when the simulated duvet cover system 10 is used on the bed 24 without a top sheet of a standard sheet set, the fill layer 16 remains out of contact with any persons located in the bed 24 as a result of this enclosure of the blanket or comforter 56. Of course, it will be appreciated that the particular size and shape of the various layers and elements of the system 10 may be modified in other embodiments to match beds of corresponding shapes and sizes without departing from the scope of the invention.

The fill layer 16 defined by the blanket or comforter 56 may be comprised of similar fabric materials as described above, as well as of various fillers as well known in the art of bedding and blanket materials. As long as the fill layer 16 is formed independently from the cover layer 12 and the backing layer 14, and is provided so as to be removable easily from the system 10, the specific materials chosen will not affect the principal beneficial functionalities of the simulated duvet cover system 10, which are discussed throughout this application. For example, the fill layer 16 will avoid most contact with persons and other sources that lead to a need to clean or launder the fill layer 16, which is beneficial for all of the reasons set forth above.

Figure 5B:
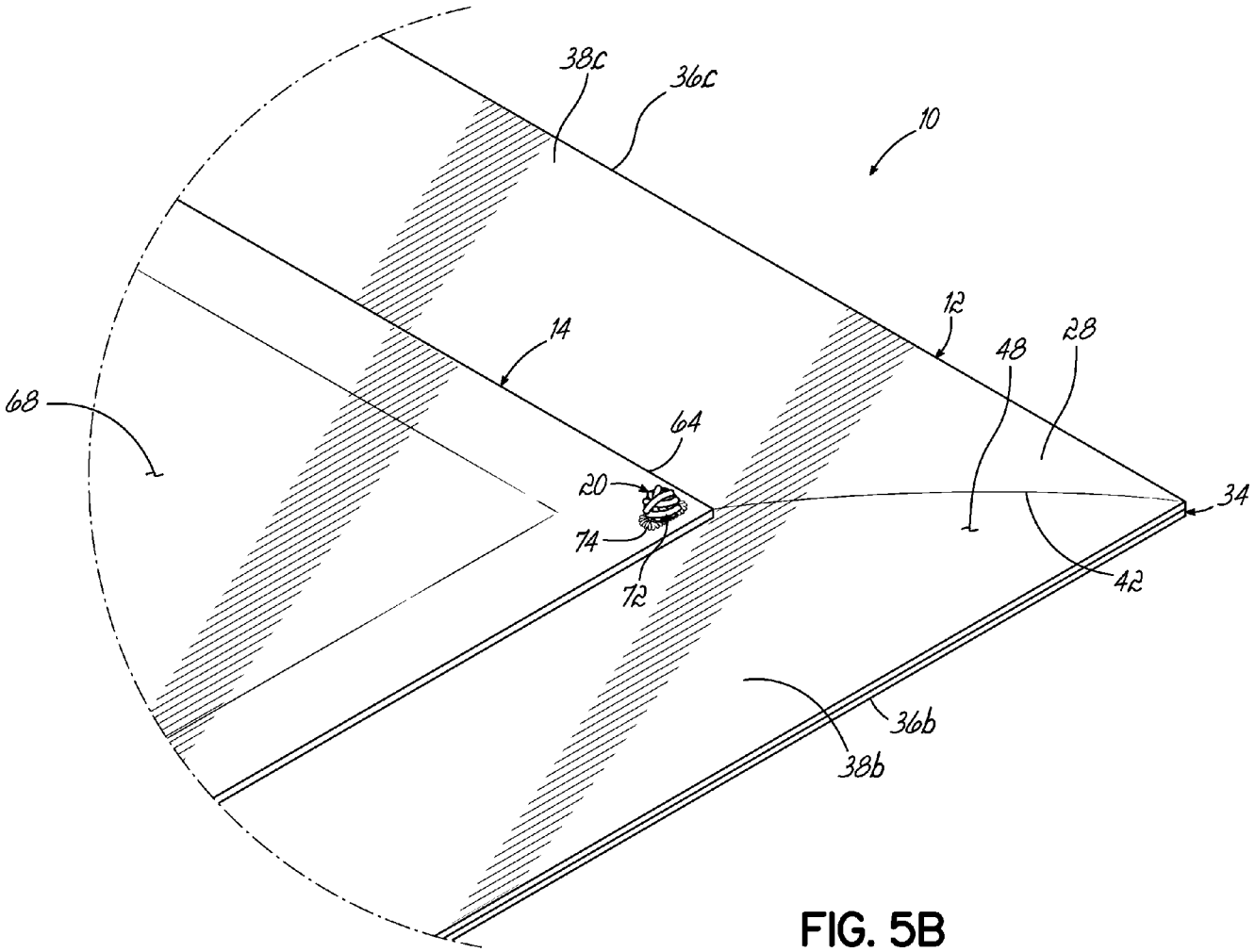
FIG. 5B is a detailed perspective view of one of the corner portions (similar to that shown in FIG. 5A) of the system of FIG. 3, with the fastening element and the layers in a fully assembled position.

The backing layer 14 of this embodiment of the simulated duvet cover system 10 is shown in further detail at FIGS. 2 and 3 and in part at FIGS. 4 through 5B. To this end, the backing layer 14 is sized to be smaller in width and length when viewed in plan compared to the cover layer 12. This sizing of the backing layer 14 keeps the backing layer 14 withdrawn from the periphery 34 of the cover layer 12 while the system 10 is in use on the bed 24, thereby making the existence of the separate backing layer 14 generally inconspicuous to persons around or in the bed 24. Therefore, the cover layer 12 and the backing layer 14 function to retain the blanket or comforter 56 like a standard conventional duvet cover, but the different construction which enables easier assembly and disassembly of the components is hidden so as to simulate the same desirable aesthetic appearance as a conventional duvet cover.

More specifically, in the illustrated embodiment of FIGS. 1 through 5B, the backing layer 14 also defines a generally rectangular shape and thereby matches the shape of the central opening 22 formed in the bottom fabric layer 28 of the cover layer 12. It will be appreciated that the backing layer 14 can be modified in shape or size to match similar variations in the central opening 22 or in other manners without departing from the scope of this invention. The backing layer 14 includes a periphery 64 that is configured to overlie the various fabric portions 38*a*-38*d* defining the bottom fabric layer 28, which allows for these elements to be connected together using the fastening elements 20. In this regard, the backing layer 14 is sized slightly larger than the central opening 22 such that the periphery 64 of the backing layer 14 overlies and covers the plurality of inner edges 40*a*-40*d* defined by the fabric portions 38*a*-38*d* of the bottom fabric layer 28. This arrangement of the layers is most clearly visible in FIG. 4, for this embodiment. In addition to covering up the central opening 22 and access to the bottom surface 60 of the blanket or comforter 56, the larger size of the backing layer 14 compared to the central opening 22 provides room for the fastening elements 20 to be provided for connecting the bottom fabric layer 28 to the backing layer 14 as shown. It will readily be understood that when the system is fully assembled with the backing layer 14 coupled to the cover layer 12 via the fastening elements 20, the fill layer 16 can be clearly secured and retained within the confines of the system 10, defined between the cover layer 12 and the backing layer 14, thereby avoiding direct contact or visibility to users of the bed 24.

Similar to the other layers described above, the backing layer 14 defines a top surface 66 configured to face towards the central opening 22 and towards the cover layer 12 when in the fully assembled position of the system, and also defines a bottom surface 68 configured to face towards the bed 24 when the system 10 is assembled and spread out onto the bed 24. The top surface 66 and the bottom surface 68 are each delimited by the periphery 64. Furthermore, the backing layer 14 may be comprised of any of the potential fabric materials and/or additives as described above for the cover layer 12. That being said, it will be understood that the backing layer 14 can be provided from a different fabric material than the cover layer 12 in some embodiments for the purposes of achieving one or more of: cost savings, a certain aesthetic appearance, and reliable retention of the fill layer 16 in the pockets 18. Likewise, the backing layer 14 can also be formed from the same material as the cover layer 12 or a portion of the cover layer 12 in other embodiments.

Having described the general elements and construction of the layers 12, 14 combined to form the simulated duvet cover system 10 of this embodiment, specific reference is now given to FIGS. 4 through 5B, where the fastening elements 20 of this embodiment are shown in further detail. In this embodiment, the fastening elements 20 are defined by fabric knot buttons 72 located on the bottom fabric layer 28 adjacent the inner edges 40*a*-40*d* thereof, and corresponding retainer apertures 74 (e.g., button holes) formed in the backing layer 14. The fabric knot buttons 72 are highly deformable or compressible to enable insertion and removal through the retainer apertures 74, which also allows for these elements on the cover layer 12 to go through industrial laundering and ironing equipment without being damaged by this equipment, and also without causing damage to this equipment. By contrast, metallic or rigid elements like snaps could cause such damage or be damaged during a cleaning and processing cycle, so the fabric knot buttons 72 are designed to avoid this issue in the commercial bedding and laundering context. Despite having the ability to deform or compress in laundering equipment, the fabric knot buttons 72 still reliably stay retained when inserted through the retainer apertures 74 as shown in FIGS. 4 and 5B. As a result, by putting a plurality of matching pairs of the fabric knot buttons 72 and the retainer apertures 74 on the cover layer 12 and the backing layer 14 (eight pairs shown in the illustrated embodiment), the fastening elements 20 removably couple these elements of the system 10 to reliably contain the fill layer 16 in the system 10, while nevertheless enabling easy assembly and disassembly of the system 10 from the fill layer 16. Moreover, the cover layer 12 and the backing layer 14 are easy and cost-efficient to manufacture in such an arrangement as compared to designs that must incorporate zippers or other complex items, which reduces the overall cost of using this system 10 in a commercial setting.

Advantageously, the fastening elements 20 are located only at certain positions on the cover layer 12 and on the backing layer 14, thereby reducing the total number of assembly points needed when assembling the simulated duvet cover system 10. In the embodiment shown in FIGS. 1 through 5B, there is one fastening element 20 proximate each corner of the central opening 22 and bottom fabric layer 28, and then one additional fastening element located along each of the inner edges 40*a*-40*d*. It will be understood that more or fewer fastening elements 20 and different configurations of positions for the fastening elements 20 may be used in other embodiments consistent with the scope of this disclosure. This arrangement of the fastening elements 20 allows for rapid assembly of the cover layer 12 and the backing layer 14, while also assuring that the system 10 remains fully assembled during normal use on the bed 24.

Although the fastening elements 20 and the separate component that is the backing layer 14 are visible in the bottom perspective or plan view shown in FIG. 3, these elements are typically hidden from view of persons when the system 10 is spread out on the bed 24. To this end, the smaller size of the backing layer 14 relative to the cover layer 12 and the fill layer 16 recesses this separate element and the associated connections at the fastening elements 20 from view. Consequently, the appearance of a conventional duvet cover is achieved, while defining an assembly of components that is easy and quick to assemble and disassemble, enabling regular cleanings of the cover layer 12 and the backing layer 14 without significant additional work in large-scale contexts such as use in hotels or hospitals. Therefore, the simulated duvet cover system 10 of this embodiment is capable of bringing these additional aesthetic and comfort benefits to these fields.

It should be appreciated that more or fewer of the fastening elements 20 may be provided in other embodiments, the locations thereof may be re-located altogether or adjusted up or down and/or left or right, as needed, and any pair of the fabric knot buttons 72 and retainer apertures 74 may be replaced or interchanged with a different type of fastener, while still retaining the overall benefits of the simulated duvet cover system 10. For example, while the fastening elements 20 have been discussed in this embodiment as fabric knot buttons 72, other types of fastening elements that are not metallic and not substantially rigid (e.g., such as hook and loop closures (e.g., VELCRO®), silicone buttons, and/or other alternatives like ties or clasps) may be used in place of some or all of the fabric knot buttons 72, while still retaining the overall benefits of the system 10. One such alternative embodiment using two different types of fastening elements is described below in connection with the embodiment of FIGS. 6 and 7. Regardless of the particular fastener chosen, the fastening elements 20 advantageously enable easy and simple separate connection of the cover layer 12 to the backing layer 14, thereby enabling an assembly process that does not discourage periodic or frequent removal of the fabric sheet layers for cleaning. Additionally, the fill layer 16 defined by the blanket or comforter 56 is securely held in position out of direct contact with persons using the bed 24, and the fastening elements 20 are configured to avoid damage when the cover layer 12 and the backing layer 14 are subjected to frequent cleaning and processing cycles using industrial laundering and ironing equipment, and the like.

As alluded to above, the process for assembling the simulated duvet cover system 10 and the fill layer 16 in accordance with this and other embodiments is simple and easy, requiring minimal time and frustration on the part of the assembling person. The assembly method begins by laying the cover layer 12 onto the bed 24 or another generally flat surface, and then inserting the fill layer 16 through the central opening 22 defined in the bottom fabric layer 28 of the cover layer 12. The fill layer 16 is then tucked into the pockets 18 defined around the central opening 22 such that the peripheral edge 50 of the fill layer 16 is positioned within the pockets 18 and adjacent to the periphery 34 of the cover layer 12. This insertion and tucking of the fill layer 16 into the pockets 18 is likely sufficient to reliably maintain these layers in the fully assembled position, but the method of assembly for this first disclosed embodiment also includes a following step of laying the backing layer 14 over the central opening 22 and then coupling the backing layer 14 to the cover layer 12 using the plurality of fastening elements 20. This coupling with the fastening elements effectively completely surrounds the fill layer 16 with the cover layer 12 and the backing layer 14, to thereby avoid direct contact of the fill layer 16 with persons and also to further assure that the fill layer 16 is retained in the fully assembled position of the system 10. The system is then ready for being spread out onto a bed like a conventional duvet cover and blanket. It will be understood that at least in part, the particular order of the steps in the method of assembly is not deemed critical to achieving the benefits of the various embodiments described herein. Regardless, the process is simple and quickly performed whenever cleaning is required of the linens at the outer layers.

Thus, it can readily be appreciated that this laying out of layers and connection together of fastening elements 20 can be quickly accomplished to positively secure the fill layer 16 in an enclosed position sandwiched between fabric sheets of the cover layer 12 and the backing layer 14. The fabric knot buttons 72, even though limited to several select positions, effectively prevent inadvertent movement of the fill layer 16 out of the pockets 18. The cover layer 12 and the backing layer 14 are easily removable and replaceable for cleaning and other purposes (and these cleaning and processing cycles can be done by industrial laundering and ironing equipment), and the system 10 hides the appearance of substantially all of the fastening elements 20 and the interfaces of the layers, so as to provide the desirable appearance of a conventionally-constructed duvet cover. Other options may be readily identified and used with this system 10, including having different decorative patterns on different cover layers 12 to allow for different aesthetic appearances to be used on the bed 24, and/or including having a tracking system with identification elements such as barcodes or RFID chips included on the layers to track a number of laundering cycles, in contexts where that information is important to know, without departing from the scope of this disclosure. Regardless, the relatively simple construction of the cover layer 12 and the backing layer 14 (and the fastening elements 20, when provided) provides a lower cost of manufacturing or fabrication for the system 10, particularly as compared to conventional duvet cover designs.

Figure 6:
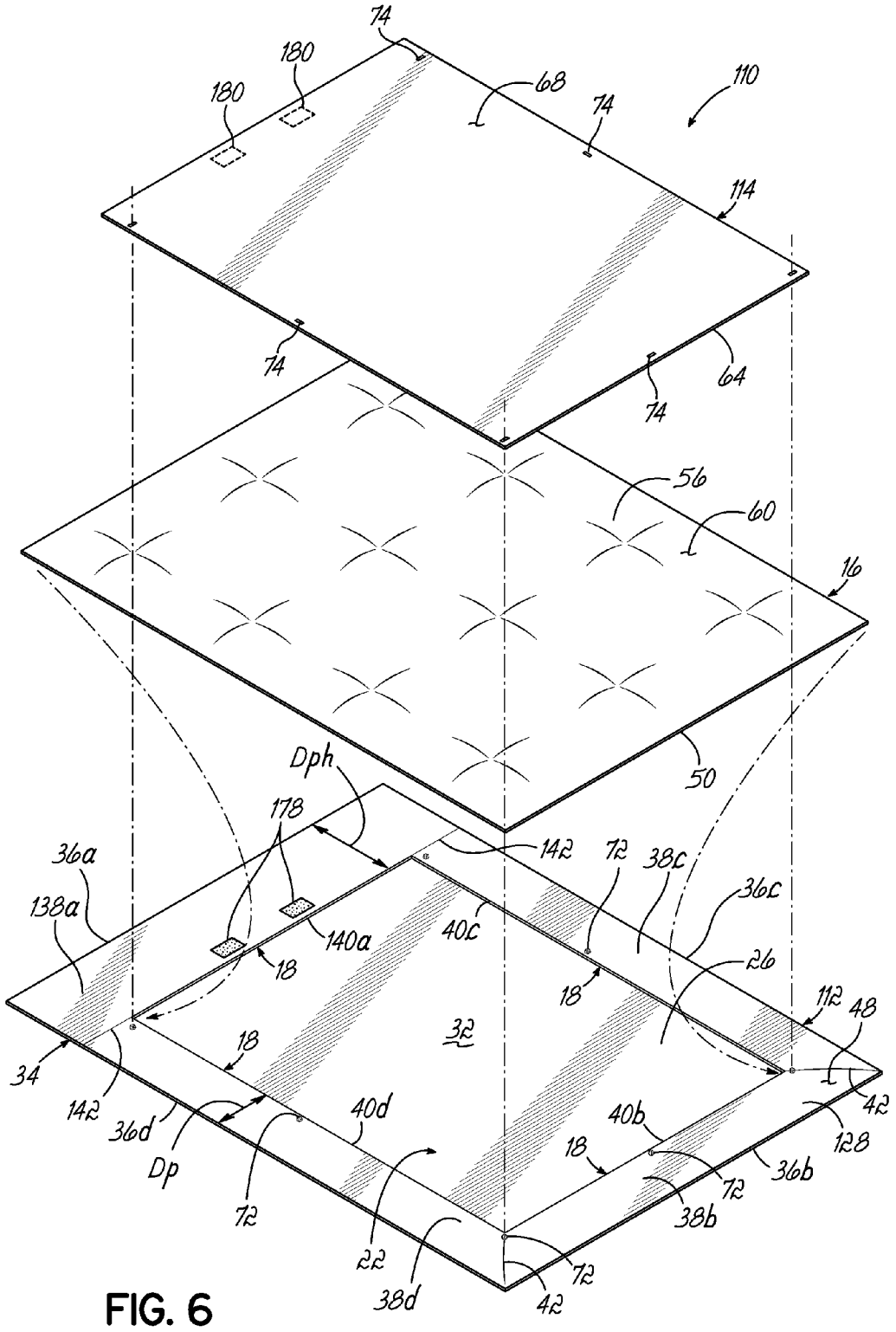
FIG. 6 is a bottom perspective view of a simulated duvet cover system and a fill layer according to another embodiment of the invention, with the plurality of layers defining the system partially exploded to reveal fastening elements used to secure these layers together when in the fully assembled state.
Figure 7:
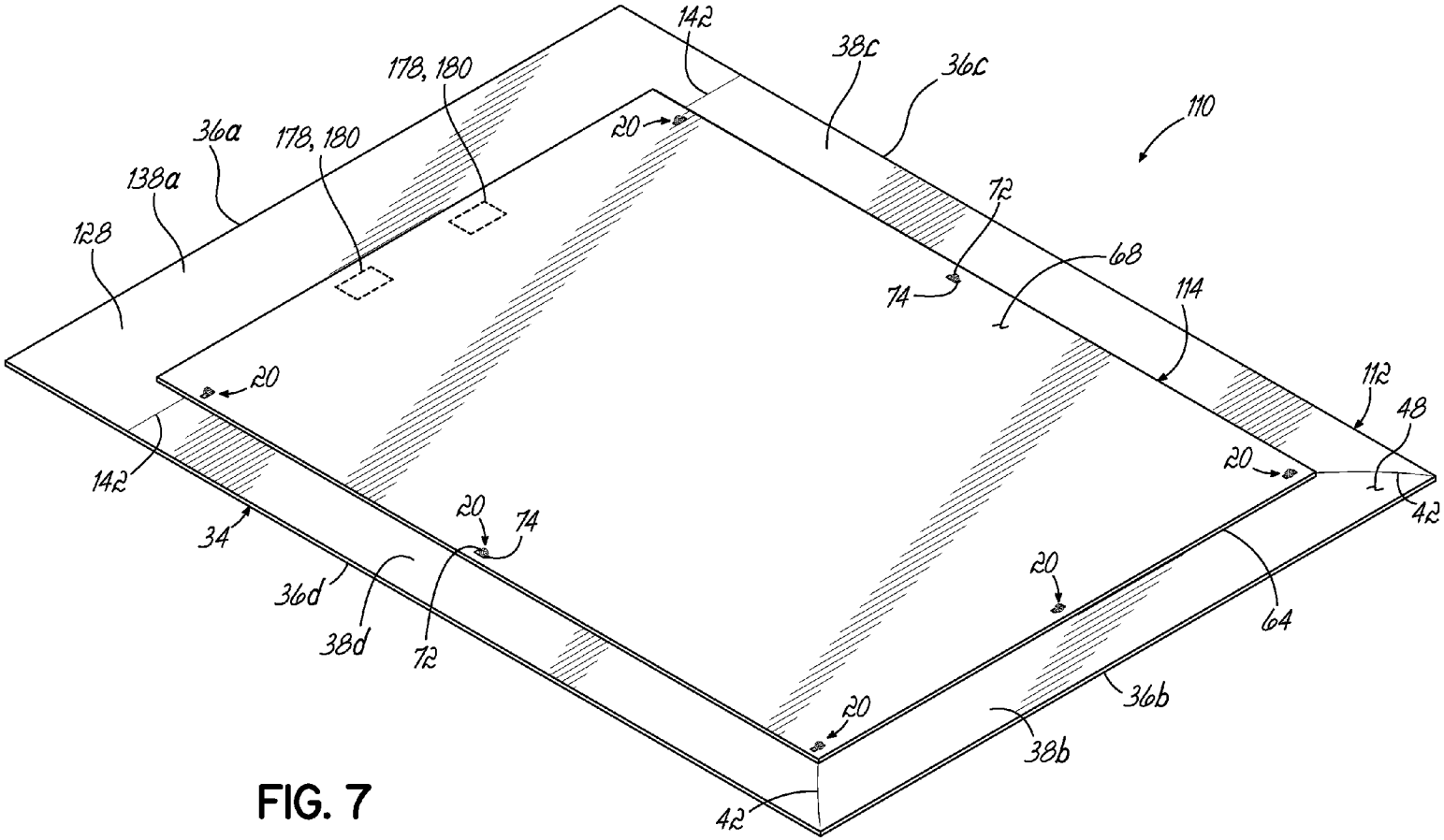
FIG. 7 is a bottom perspective view of the simulated duvet cover system of FIG. 6, with the system laid out in a completely horizontal orientation, and the system in the fully assembled state.

With reference to FIGS. 6 and 7, one alternative embodiment of the simulated duvet cover system 110 is shown. FIGS. 6 and 7 include similar views in exploded and fully assembled positions of the system 110 as in FIGS. 2 and 3 of the first described embodiment, and identical elements from that first embodiment of the system 10 have been applied with the same reference numbers without further comment or description herein. One difference in this embodiment of the system 110 is the use of two different types of fastening elements to connect the cover layer 112 to the backing layer 114. More particularly, the bottom fabric layer 128 of this embodiment includes a plurality of fabric knot buttons 72 as previously described, but along at least one of the fabric portions 138*a* and inner edges 140*a*, the bottom fabric layer 128 includes hook and loop fastener panels 178 (e.g., such as VELCRO®) to define a different type of fastening element. The hook and loop fastener panels 178 may be sewn into position on the bottom surface 48 of the bottom fabric layer 128, or otherwise secured in position as known in the art. Likewise, the backing layer 114 of this embodiment is modified to match this arrangement of the fastening elements. To this end, the backing layer 114 again includes a plurality of retainer apertures 74 positioned to receive the fabric knot buttons 72, but the backing layer 114 also includes corresponding hook and loop fastener panels 180 to connect to the corresponding panels 178 on the cover layer 112. Just like the fabric knot buttons 72 and retainer apertures 74, the hook and loop fastener panels 178, 180 are configured for easy assembly and disassembly of the layers of the system 110 while also being capable of going through industrial laundering and ironing equipment without being damaged or causing damage.

Another difference in the system 110 shown in the embodiment of FIGS. 6 and 7 is the arrangement and sizing of the pockets 18 and the sew lines 42 provided in the picture frame-shaped receptacle defined by the cover layer 112. In this regard, the pocket 18 formed along the head end edge 36*a* of the cover layer 112 has been made larger in size than the other pockets 18. For example, the fabric portion 138*a* of the bottom fabric layer 128 which is located along the head end edge 36*a* defines a larger depth $D_{ph}$ than the depth $D_p$ of the other fabric portions 38*b*-38*d* and corresponding pockets 18. This depth variation is most readily apparent in the exploded view of FIG. 6. As alluded to above, this formation of the pockets 18 with different sizes or depths does not affect the beneficial functionality of the cover layer 112 in removably retaining the fill layer 16 as described in detail above, and therefore does not depart from the scope of this invention. Additionally, the larger fabric portion 138*a* along the head end edge 36*a* is fully rectangular in shape and therefore does not need to be connected by sewing along diagonal corner sew lines 42 as in the previous embodiment. Instead, the sew lines 142 at the junction of an inner edge 140*a* of that fabric portion 138*a* with the other fabric portions 38*c*, 38*d* are spaced apart from the head end edge 36*a* by a significant amount of space. To this end, it will be appreciated that other embodiments of the system can reposition the sew lines as needed without departing from the scope of the invention.

This arrangement of the larger head end pocket 18 and the sew lines 142 in this embodiment of the system 110 allows the system 110 to maintain the appearance of a conventional duvet cover in other typical circumstances beyond the one shown in FIG. 1 of how the system 110 is laid out on the bed 24. To this end, users will often fold down or back a portion of the duvet cover at the head end when it is not desired to put the pillows on top of the duvet cover. If this type of fold back were applied without the larger head end pocket 18 and sew lines 142 of the FIGS. 6 and 7 embodiment, the corner sew lines 42 near the head end edge 36*a* would be visible. However, those sew lines 42 are omitted in favor of sew lines 142 which are recessed back from the head end edge 36*a* in the system 110 of this embodiment, which means that the intersection and construction of different portions of the bottom fabric layer 128 remains hidden even in the folded back state, thereby maintaining the desired standard duvet cover appearance regardless of which normal way a user places and lays out the system 110 on the bed 24.

In all other respects, the system 110 of this embodiment functions in the same manner and provides the same benefits as the first embodiment. For example, the system 110 is assembled in exactly the same manner as the method described above, with the removable connection of the cover layer 112 and the backing layer 114 being made by two different types of fastening elements 20 rather than just one. The cover layer 112 and the backing layer 114 of this embodiment continue to be removable from the fill layer 16 for separate cleaning, which can be completed without damage to or from industrial laundering and ironing equipment, and then easy and quick re-assembly for further use on the bed 24. The existence of a separate backing layer 114 and the fastening elements 20 remain generally hidden from view during normal use on the bed 24 so as to provide the desirable appearance of a conventionally-fabricated duvet cover. It will be understood that these different features shown with respect to the embodiment of the system 110 in FIGS. 6 and 7 can be combined in any combination with features of previous embodiments without departing from the scope of this invention.

Figure 8:
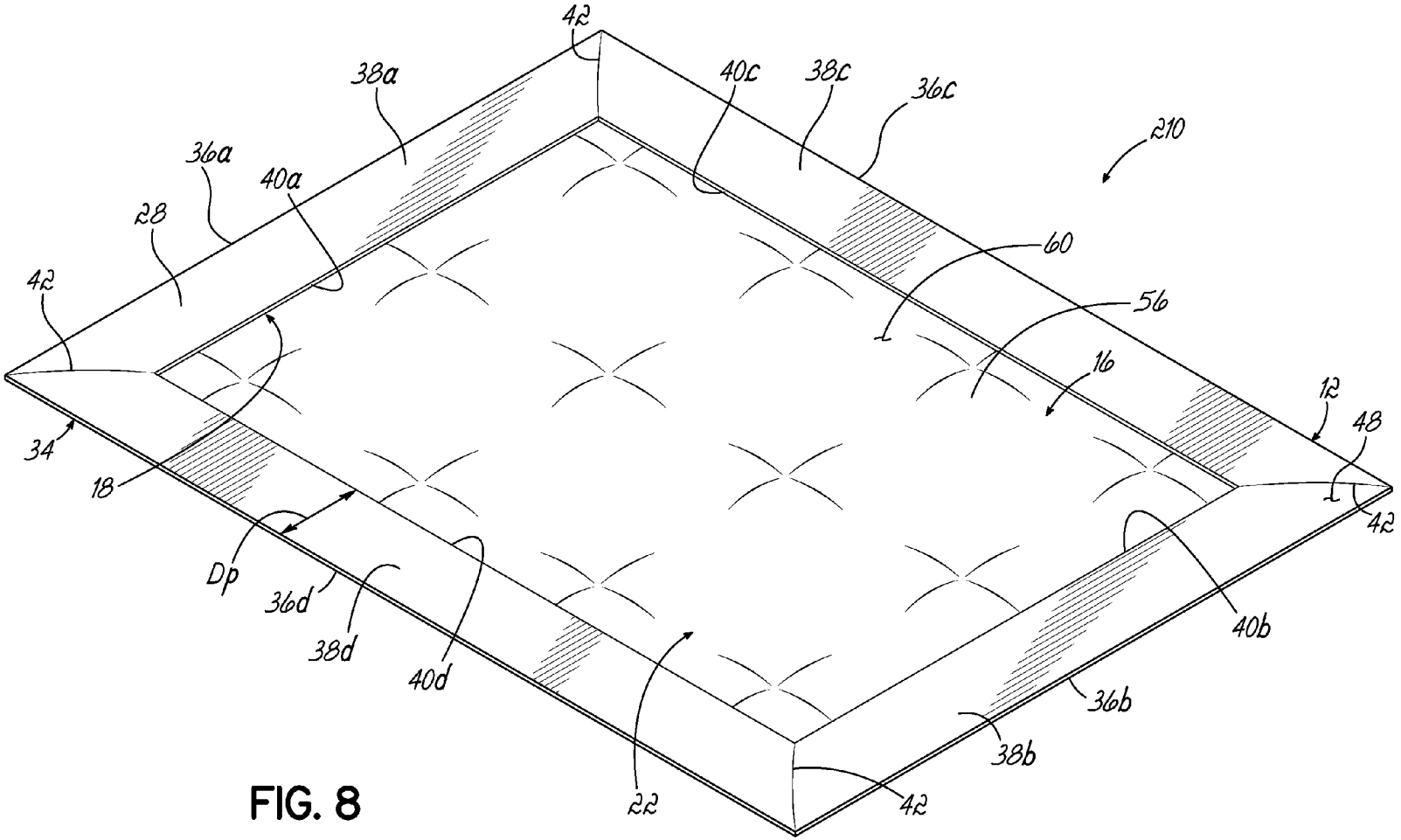
FIG. 8 is a bottom perspective view of a simulated duvet cover system according to yet another embodiment of the invention, with the system laid out in a completely horizontal orientation, and the system of this embodiment including only two layers combined in the fully assembled state to retain the fill layer therein.

With reference to FIG. 8, a further alternative embodiment of the simulated duvet cover system 210 is shown. FIG. 8 includes a similar view in fully assembled form of the system 210 as in FIG. 3 of the first described embodiment, and identical elements from that first embodiment of the system 10 have been applied with the same reference numbers without further comment or description herein. A difference in this embodiment of the system 210 is the omission of the backing layer and the fastening elements. To this end, the system 210 includes only the cover layer 12 in the full assembly. In regions such as the Americas, it is typical for a top sheet of a sheet set to be used in conjunction with blankets or comforters. When such a top sheet is used, the bottom side of a duvet cover or blanket/comforter is not exposed to persons laying in the bed 24, as the top sheet is located between the persons and the duvet. Thus, in such regions, the backing layer can be omitted because the fill layer 16 will still not be directly contacted by persons in the bed 24 during normal use of the bed 24. As set forth above, the pockets 18 defined by the cover layer 12 must be configured and sized to reliably maintain the fill layer 16 in the tucked in position even without the backing layer in place. However, as the bottom side of the system 210 shown in FIG. 8 would not normally be visible when the system 210 is flipped over and placed on the bed 24, the same appearance of a conventional duvet cover can be achieved by this embodiment in the same manner as the first embodiment and as shown in FIG. 1. In other words, the cover layer 12 and the top sheet prevent direct contact with the fill layer 16 while providing the desirable appearance of a conventional duvet cover.

Another similar alternative embodiment of a simulated duvet cover system 310 is shown in FIG. 9, again in bottom plan view fully assembled. Identical elements from that first embodiment of the system 10 have been applied with the same reference numbers without further comment or description herein. In this embodiment, the cover layer 312 of the system 310 is modified to have pockets 18 which vary in size from one another. More specifically, the fabric portions 338*a* and 338*b* of the bottom fabric layer 328, which are located along the head end edge 36*a* and the foot end edge 36*b* of the cover layer 312, define a larger depth $D_p$, than the depth $D_p$ of the other fabric portions 38*c* and 38*d* and their corresponding pockets 18. The larger depth $D_p$, of these head and foot end pockets 18 is adapted to assist with reliably retaining the fill layer 16 in the fully assembled position and tucked into the pockets 18. For example, the larger pockets may be necessary in embodiments where the fill layer 16 is larger, to complete the design objective of a duvet cover design.

However, the system 310 is manufactured and functions in the same manner as the previous embodiment (210) without the backing layer. When used in conjunction with a top sheet on the bed 24, the cover layer 312 prevents direct human contact with the fill layer 16 while reliably retaining the system 310 in the assembled position. Although the depths $D_{px}$ and $D_p$ are each used with two pockets 18 as shown, it will be understood that further variations of size of the pockets 18 may be used without departing from the scope of this invention (e.g., up to and including having all of the pockets define a different size than all other pockets).

Figure 9:
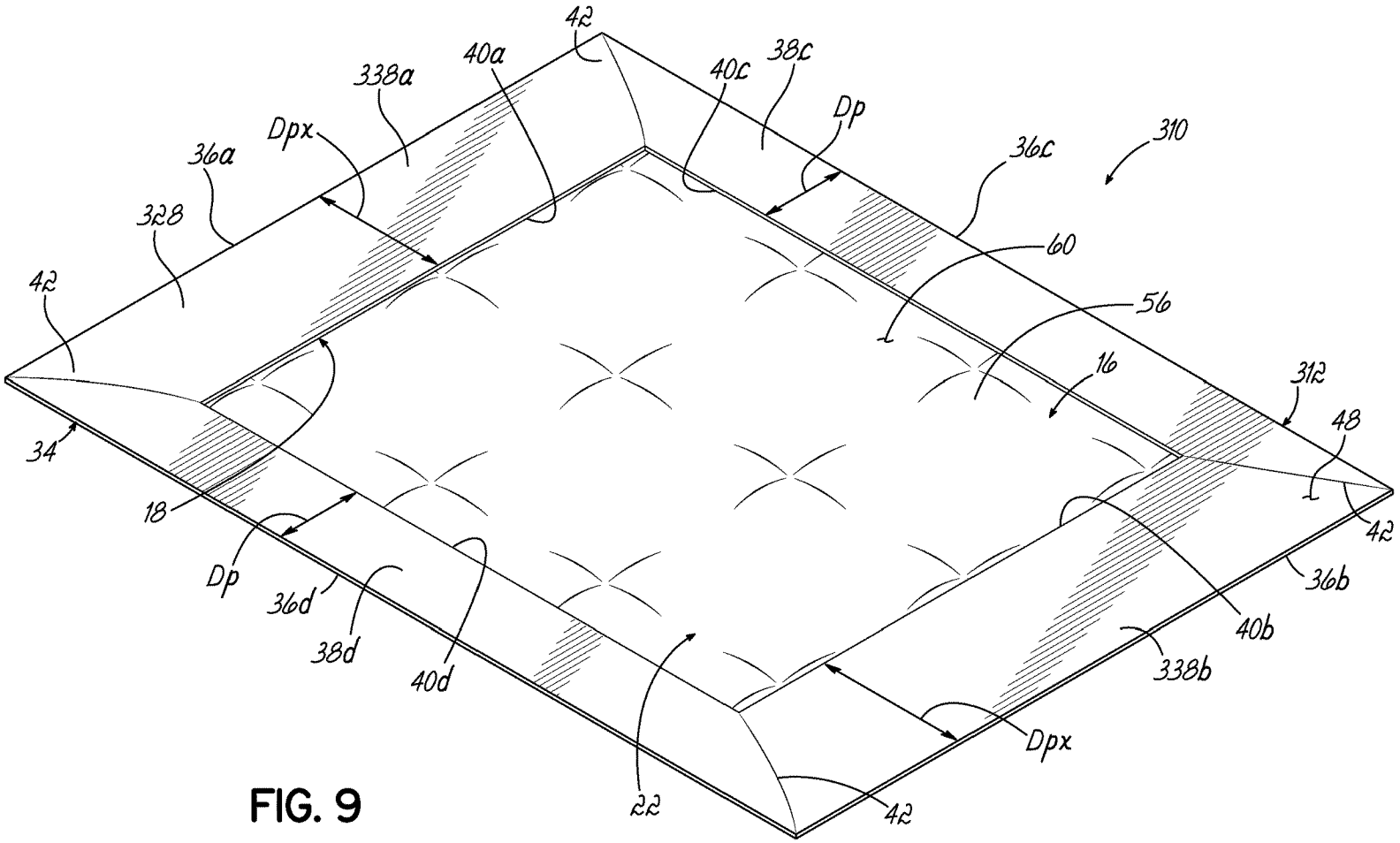
FIG. 9 is a bottom perspective view of a simulated duvet cover system according to a further embodiment of the invention, the system of this embodiment being similar to the one in FIG. 8 but for the sizing of the pockets at one of the layers.

In all other respects, the systems 210 and 310 of the embodiments shown in FIGS. 8 and 9 function in substantially the same manner and provides the same benefits as the previous embodiments. For example, the systems 210 and 310 are assembled using the same process as set forth in detail above, but with the further omission of any need to lay out or couple a backing layer to the cover layer. To this end, the process for assembling or disassembling the systems 210, 310 is even more easy and quick than the prior embodiments as a result of fewer steps being required and as a result of the backing layer being optional in some regions where top sheets are typically used on beds. The cover layer 12, 312 of these embodiments continue to be removable from the fill layer 16 for separate cleaning, which can be completed without damage to or from industrial laundering and ironing equipment (as a result of the cover layer 12, 312 not having any fastening elements or non-fabric sheet layers in the construction thereof), and then easy and quick reassembly for further use on the bed 24. The fill layer 16 and the central opening 22 in the cover layers 12, 312 remain generally hidden from view during normal use on the bed 24 so as to provide the desirable appearance of a conventionally-fabricated duvet cover. It will be understood that these different features shown with respect to the embodiments of the system 210 and 310 in FIGS. 8 and 9 can be combined in any combination with features of previous embodiments without departing from the scope of this invention.

While the present invention has been illustrated by a description of various embodiments and while these embodiments have been described in considerable detail, it is not the intention of the applicant to restrict or in any way limit the scope of the appended claims to such detail. Additional advantages and modifications will readily appear to those skilled in the art. Thus, the invention in its broader aspects is therefore not limited to the specific details, representative apparatus and method and illustrative example shown and described. Accordingly, departures may be made from such details without departing from the spirit or scope of applicant's general inventive concept.

What is claimed is:

1. A simulated duvet cover system for encasing and retaining a fill layer defined by at least one of a blanket or a comforter, and thereafter to be used for covering a bed, the system comprising:

a top fabric layer including a periphery having a plurality of side edges; and a bottom fabric layer connected to the top fabric layer and extending inwardly from the periphery at each of the plurality of side edges to form pockets extending along the periphery, the bottom fabric layer defining and surrounding a central opening extending between the pockets, the top and bottom fabric layers collectively defining a cover layer configured to receive a fill layer by insertion of the fill layer through the central opening and tucking of the fill layer into the pockets to sandwich the fill layer between the top and bottom fabric layers, with the pockets being sized to retain the fill layer in a fully assembled position, and wherein the cover layer is configured to be removed for cleaning separate from the fill layer, and wherein each of the pockets defines a depth measured between the central opening and the corresponding side edge, with the depth of some of the pockets being different from others, such that the pockets are differently sized, wherein the periphery of the top fabric layer includes a head end edge configured to extend along a head end of the bed, a foot end edge configured to extend along a foot end of the bed, and first and second side edges extending between the head end edge and the foot end edge, wherein the pocket which extends inwardly from the head end edge is larger in size and depth than at least one of the remaining pockets, and wherein the pocket which extends inwardly from the head end edge is defined by a generally rectangular piece of fabric defining an inner edge opposite the head end edge, with the pocket which extends inwardly from the head end edge being sewn to a remainder of the bottom fabric layer along the inner edge such that any sew lines formed in the bottom fabric layer are spaced apart from the head end edge.

2. The simulated duvet cover system of claim 1, wherein the pockets and the central opening of the bottom fabric layer collectively define a picture frame-shaped receptacle configured to retain the fill layer in position relative to the cover layer.

3. The simulated duvet cover system of claim 1, wherein the cover layer includes no metallic or substantially rigid elements, which could damage industrial laundering and ironing equipment during a cleaning and processing cycle.

4. The simulated duvet cover system of claim 1, wherein each of the pockets extends between about 12 inches and 24 inches from the corresponding side edge of the periphery.

5. The simulated duvet cover system of claim 1, wherein the top fabric layer comprises a decorative pattern for covering a bed.

6. The simulated duvet cover system of claim 1, wherein the bottom fabric layer is formed from a different material than the top fabric layer, the bottom fabric layer is coupled to the top fabric layer along the periphery.

7. The simulated duvet cover system of claim 1, wherein the bottom fabric layer is formed from portions of the top fabric layer that are folded over at the periphery and sewn together at junctions of the portions located in the bottom fabric layer.

8. The simulated duvet cover system of claim 1, further comprising:

a backing layer that is smaller in size than the cover layer, the backing layer being configured to cover the central opening of the bottom fabric layer; and a plurality of fastening elements that removably couple the backing layer to the bottom fabric layer at the pockets.

9. The simulated duvet cover system of claim 8, wherein the backing layer is formed from a different material than the cover layer.

10. The simulated duvet cover system of claim 8, wherein the backing layer and the cover layer are formed from a same material.

11. The simulated duvet cover system of claim 8, wherein the fastening elements are defined by materials that will not be damaged by, nor cause damage to, industrial laundering and ironing equipment during a cleaning and processing cycle.

12. The simulated duvet cover system of claim 11, wherein the fastening elements include fabric knot buttons and retainer apertures provided on the backing layer and on the bottom fabric layer.

13. The simulated duvet cover system of claim 11, wherein the fastening elements include at least two different types of fasteners.

* * * * *